United States Patent [19]

Miyake et al.

[11] Patent Number: 4,576,029

[45] Date of Patent: Mar. 18, 1986

[54] METHOD OF COILING THIN STRIPS

[75] Inventors: Hidenori Miyake; Shunji Fujiwara; Yoshio Nakazato; Fumiya Yanagishima; Toko Teshiba, all of Chiba, Japan

[73] Assignee: Kawasaki Steel Corporation, Kobe, Japan

[21] Appl. No.: 633,130

[22] Filed: Jul. 20, 1984

[51] Int. Cl.[4] ..... B21B 39/08

[52] U.S. Cl. ..... 72/205

[58] Field of Search ..... 72/146, 147, 148, 183, 72/205, 371

[56] References Cited

U.S. PATENT DOCUMENTS

| | | | |
|---|---|---|---|
| 3,201,297 | 8/1965 | Canfor | 156/184 |
| 3,709,017 | 1/1973 | Vydrin et al. | 72/205 |
| 4,054,046 | 10/1977 | Eibe | 72/184 |

FOREIGN PATENT DOCUMENTS

| | | | |
|---|---|---|---|
| 2734472 | 2/1979 | Fed. Rep. of Germany | 72/205 |
| 3049224 | 7/1982 | Fed. Rep. of Germany | 72/205 |
| 54-42346 | 4/1979 | Japan | 72/205 |
| 56-14017 | 2/1981 | Japan | 72/205 |

OTHER PUBLICATIONS

Patent Abstracts of Japan, Vol. 7, No. 71, March 24, 1983 (M-202) (1216) and JP-A-58-317.

*Primary Examiner*—E. Michael Combs

*Attorney, Agent, or Firm*—Balogh, Osann, Kramer, Dvorak, Genova & Traub

[57] ABSTRACT

A method of coiling a thin strip on a tension reel, which comprises coiling a strip rolled to a thickness of not more than 0.3 mm through a last stand of a cold tandem mill at different values of delivery side tension of the last stand and coiling tension produced by arranging a tension control means between the last stand and the tension reel.

1 Claim, 10 Drawing Figures

METHOD OF COILING THIN STRIPS

This invention relates to a method of coiling thin strips, and more particularly to a method of advantageously coiling a thin strip, which is obtained by cold rolling a hot rolled steel strip through tandem mill, without causing the breakage of the strip and the deterioration of the coiled form.

In FIG. 1 is schematically shown the conventional arrangement of a tension reel at a delivery side of the tandem mill, wherein a hot rolled steel strip 1 passed through a pickling step is cold rolled through a last stand 3*a* of the tandem mill 3 and then coiled on a tension reel 5 through a deflector roll 4 to form a coil 2 as shown in FIG. 1. In such a coiling line, a delivery side tension of the last stand 3*a* in the tandem mill as such is a coiling tension. In the conventional coiling apparatus, therefore, the tension between the last stand 3*a* and the tension reel 5 serves not only for the rolling in principle but also for the coiling.

As mentioned above, the conventional coiling technique is generally a system using the tension both as a rolling tension and a coiling tension. In this case, it is common sense to set the above tension at a certain higher value from the viewpoint of rolling priority. Particularly, this trend is conspicuous in case of coiling a thin strip with a small thickness. Because, when the tension is too low, a slipping or chattering is produced between work rolls 6 of the tandem mill and the strip 1, which adversely affects the product quality.

The term "slipping" used herein means that a neutral point as defined later comes off from a contact arc between the work roll 6 and the strip 1, resulting in the breakage of the strip 1. Further, the term "chattering" used herein means that the neutral point violently vibrates in the contact arc toward the entry and delivery sides, which fluctuates the thickness of the strip 1 or results in the breakage thereof.

When the rolling is preferential rather than the coiling as described above, the coil 2 is wound on the tension reel 5 at a tension higher than the necessary one, so that the deformation of the coil after the taking out from the reel 5 is caused to the buckling of the inner coiled portion as shown in FIG. 2*a*. This phenomenon is remarkably watched in case of thin materials having a small thickness, which adversely affects the product quality.

The coiled form of the strip and the like will be qualitatively described in detail with reference to FIG. 3, wherein an ordinate represents a tension and an abscissa represents a thickness of a strip. In FIG. 3, a left-hand upside region (A) divided by a borderline ab is a buckling deformation region of the coil. On the other hand, when the coiling tension is too low, the whole of the coil is deformed into an ellipsoidal form as shown in FIG. 2*b*, a region of which is a left-hand downside portion divided by a borderline cd and can be represented as an ellipsoidal deformation region (B). Therefore, in case of strips with a thickness of not less than $t_1$, the coiling can be carried out at a tension of $\sigma_1$ without causing the coil deformation. On the contrary, a region (C) defined between a borderline ef and a borderline gh is optimum in the coiled form viewing from the rolling property, because the slipping or chattering is caused at a region beneath the borderline gh and the breakage of the strip is caused at a region above the borderline ef.

As apparent from the above, when the thickness of the strip is more than $t_2$, the setting of $\sigma_2$ is possible as a tension without damaging the rolling property and causing the coil deformation, but when the thickness of the strip is within a range of $t_1$–$t_2$, the coil deformation (buckling) is caused in view of the rolling priority.

In order to prevent the buckling deformation of the coil, therefore, there have hitherto been adopted two methods, one of which being a method wherein a steel strip having, for example, a thickness of $t_1$ is coiled on a cylinder, which is made of steel or the like and fitted onto the tension reel, at a tension $\sigma_3$ shown by a point R of FIG. 3, and the other of which being a method wherein a top portion of the strip corresponding to the inner coiled portion is rolled at an intentionally thick thickness taking notice of a fact that the buckling occurs in the inner coiled portion. In the latter method, for instance, the top portion of the steel strip having a thickness of $t_1$ is coiled at a tension $\sigma_3$ so as to obtain a thickness of $t_3$ shown by a point S.

However, the former method is disadvantageous in the production cost of the cylinder, the workability and the safety, while the latter method considerably deterioriates the yield of product.

Moreover, it has experimentally been confirmed that the critical thickness $t_2$ shown in FIG. 3 is approximately 0.30 mm.

The invention is to provide a coiling method which can advantageously solve the aforementioned problems of the prior art even when using a thin strip with a thickness of less than 0.30 mm. Such an object can be achieved by a concrete construction as described below.

The invention will now be described in detail with reference to the accompanying drawing, wherein:

FIG. 1 is a schematic view illustrating the conventional arrangement of tandem mill and tension reel;

FIGS. 2*a* and 2*b* are front views showing the form of coil deformed due to the poor coiling tension, respectively;

Figure 4:
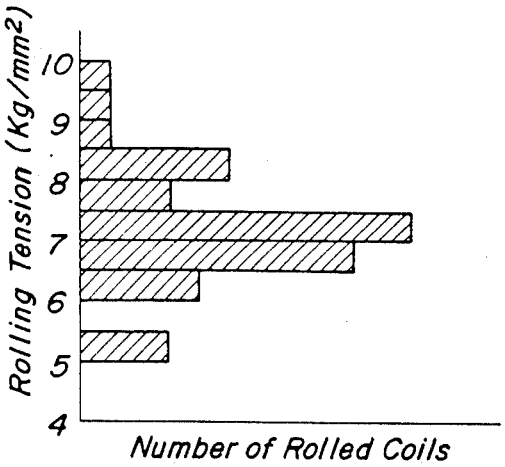
FIG. 4 is a graph showing the tension distribution at delivery side of last stand when cold rolling a strip with a thickness of about 0.2 mm.

In FIG. 4 is shown a delivery side tension distribution of a last stand in a cold tandem mill for a steel strip having a thickness of about 0.2 mm, wherein an abscissa represents the number of rolled coils. As apparent from FIG. 4, the actual rolling tension is within a range of 5–10 kg/mm$^2$, particularly 7.0–7.5 kg/mm$^2$. When the rolling tension is less than 5 kg/mm$^2$, the rate of slipping and chattering generated rapidly increases, while when the rolling tension exceeds 10 kg/mm$^2$, the buckling deformation of the coil frequently occurs although the rolling is preferential rather than the coiling. However, it has been confirmed from many experiments that the rolling tension of about 16 kg/mm$^2$ is critical for the strip breakage regardless of the coil deformation. In the standpoint of the rolling priority, therefore, it has been found that the optimum value of the rolling tension or delivery side tension of last stand is within a range of 5–16 kg/mm$^2$.

Figure 5:
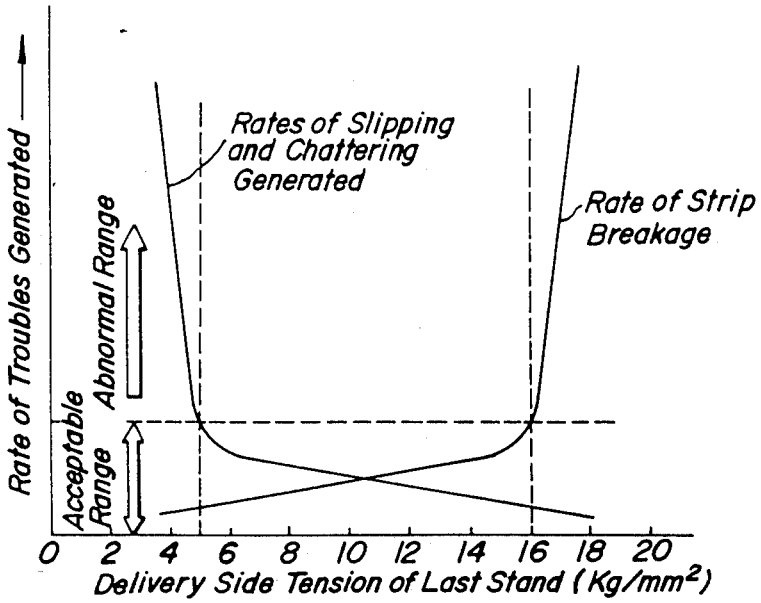
FIG. 5 is a graph showing an influence of the delivery side tension of last stand on the rolling property.

The above is diagrammatically shown in FIG. 5. But, this phenomenon is first true of a case involving some troubles produced in the operation which are accepted to a certain extent when using a thin strip with a thickness of less than 0.30 mm.

In general, a point that the strip passing speed or rolling speed matches with the peripheral speed of the work roll in the rolling machine is called as a neutral point. Now, it was examined how to influence the position of the neutral point by the delivery side tension of the last stand and coefficient of friction between the strip and the work roll.

Figure 6:
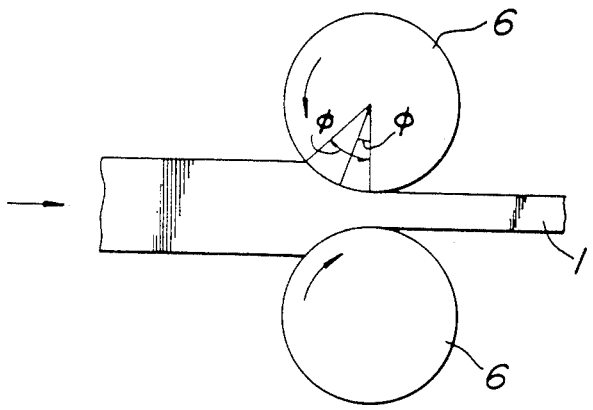
FIG. 6 is a diagrammatic view showing a relation between contact angle and neutral angle.

At first, the position of the neutral point was determined as a ratio of neutral angle $\sigma_n$ to contact angle $\phi$ as shown in FIG. 6. In this case, there were utilized Hill's rolling load equation. Hitchcock's roll flattening equation and Bland & Ford's neutral point equation as mentioned below:

$$P = \bar{k}\sqrt{R'\Delta h}\ \{1.08 + 1.79\,\mu r\sqrt{R'/hi} - 1.02\,r\}$$

$$R' = R(1 + CoP/\Delta h)$$

$$Co = \frac{8(1 - m^2)}{\pi E}$$

$$\phi_n = \sqrt{\frac{ho}{R'}}\left(\sqrt{\frac{ho}{R'}}\cdot\frac{Hn}{2}\right)$$

$$Hn = \frac{Hi}{2} - \frac{1}{2\mu}\,l_n\left[\left(\frac{hi}{ho}\right)\left(\frac{1 - to/ko}{1 - ti/ki}\right)\right]$$

$$Hi = 2\sqrt{\frac{R'}{ho}}\ \tan^{-1}\left(\sqrt{\frac{R'}{ho}}\ \phi\right)$$

$$\phi = \sqrt{\frac{\Delta h}{R'}}$$

wherein P is a rolling load, E is a Young's modulus, $\bar{k}$ is an average deformation resistance, $\phi_n$ is a neutral angle, R is a roll diameter, Hn and Hi are nondimensional quantities, R' is a flattened roll diameter, t is a tension, h is a thickness, k is a deformation resistance, $\Delta h = hi - ho$, $\phi$ is a contact angle, $\mu$ is a coefficient of friction, r is a reduction ratio, m is a Poisson's ratio, suffixes i and o are entry side and delivery side, and suffix n is a neutral point.

Figure 7:
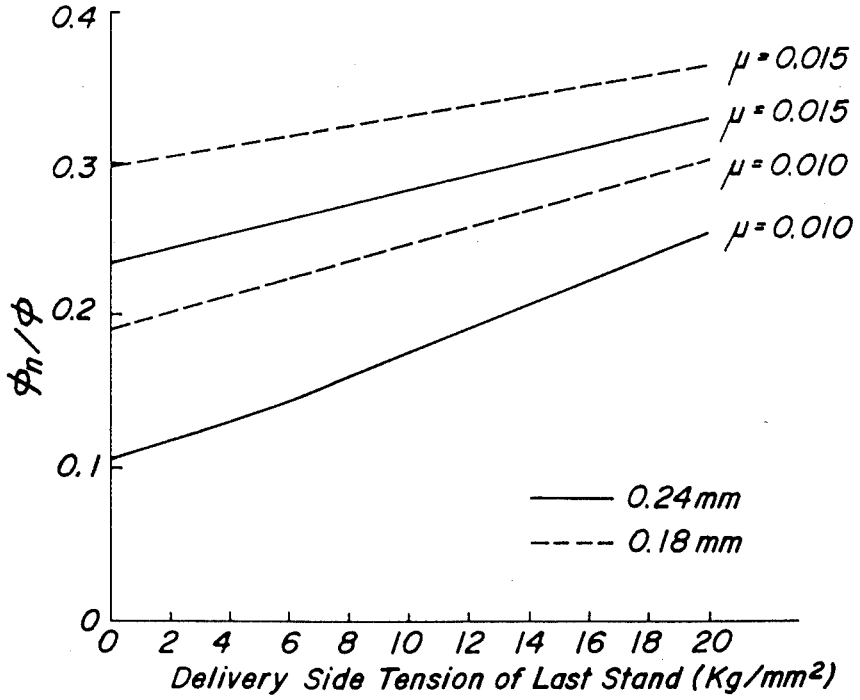
FIG. 7 is a graph showing an influence of friction coefficient on the delivery side tension of last stand and the ratio of neutral angle to contact angle.

The calculation results from the above equations are shown in FIG. 7. As a result, when the delivery side tension of the last stand is too small, the ratio of $\phi_n/\phi$ is also smaller. Further, in case of the strips having the same thickness, the influence of friction coefficient $\mu$ on $\phi_n/\phi$ is large as the tension is small. In other words, when the friction coefficient is changed by external disturbances such as uneven adhesion of rolling oil and the like, the change of the neutral point is violent as the tension becomes smaller. This supports the tendency of FIG. 5 that the chattering and slipping are apt to be caused as the delivery side tension of the last stand reduces.

Figure 8:
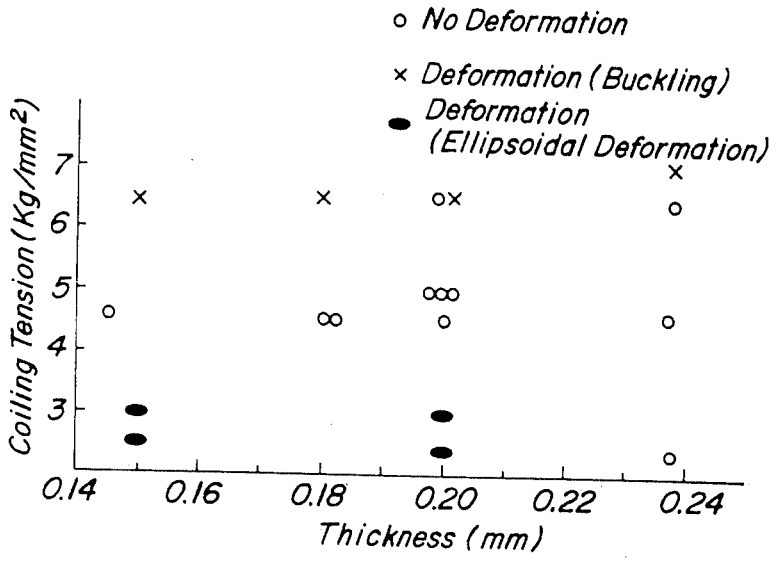
FIG. 8 is a graph showing an influence of relation between coiling tension and thickness on coil deformation.

In FIG. 8 is shown a relation between the coiling tension and the thickness when the strip is coiled at a certain tension. It is understood from FIG. 8 that the optimum coiling tension is within a range of 4–7 kg/mm$^2$, particularly about 5 kg/mm$^2$.

Figure 1:
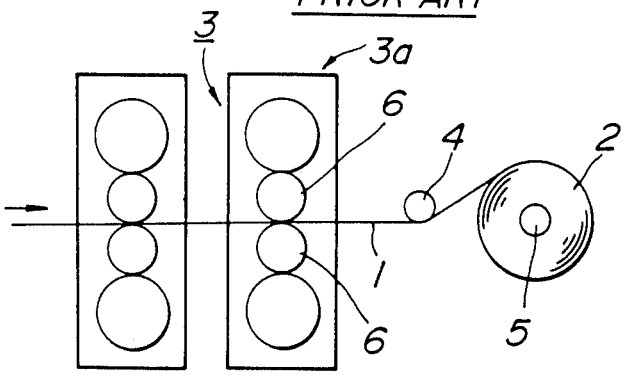
FIG. 1 PRIOR ART
Figure 2A:
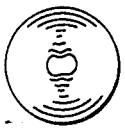
Figure 2B:
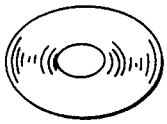
Figure 3:
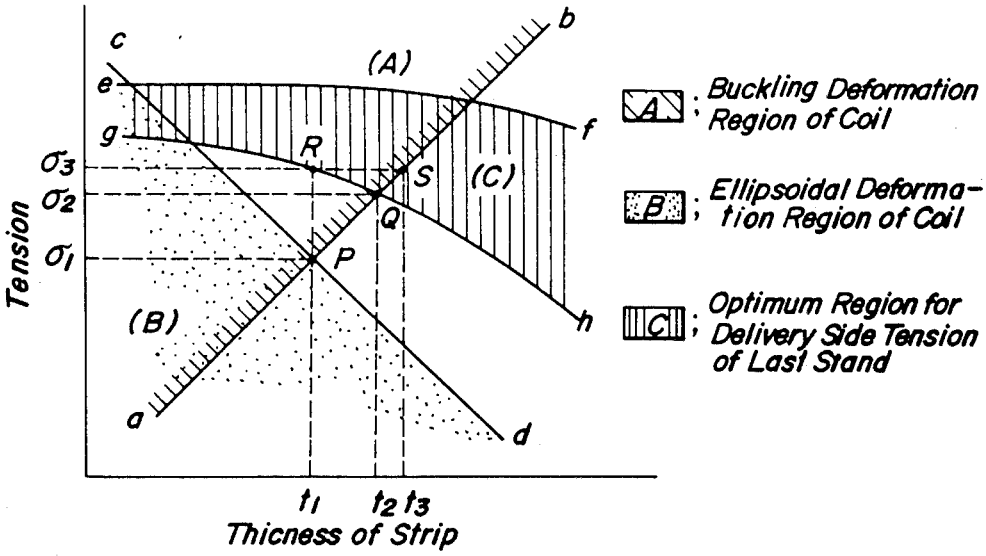
FIG. 3 is a graph showing the coil deformation limit determined by the coiling tension and the thickness of strip as well as the optimum tension range at delivery side of last stand.

Moreover, the qualitatively examined tendency for the influence of coiling tension on the coiled form in FIG. 3 can also be read from FIG. 8.

According to the invention, therefore, it has been found from the above that the optimum delivery side tension of the last stand is 5–16 kg/mm$^2$ and the optimum coiling tension is 4–7 kg/mm$^2$ in the coiling of thin strips, particularly strips having a thickness of not more than 0.3 mm.

In order to satisfy both the rolling property and coiled form for the thin strip, according to the invention, a tension control means capable of controlling the above tension ranges, such as tension bridle roll, linear motor type means or the like is arranged between the last stand of the cold tandem mill and the tension reel.

Figure 9:
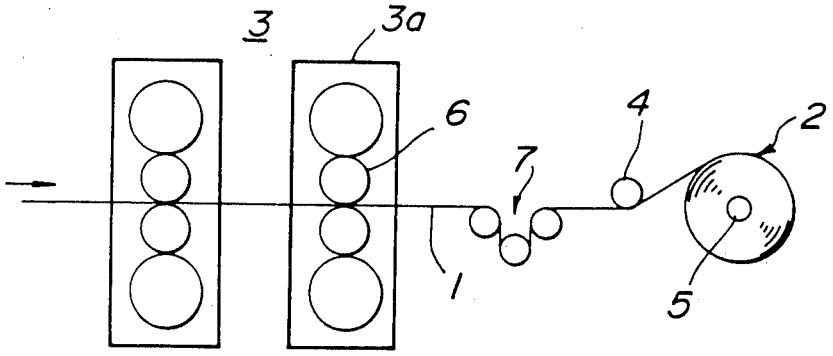
FIG. 9 is a schematic view illustrating the arrangement at the delivery side of the cold rolling equipment according to the invention comprising a tension bridle roll between the last stand and the tension reel.

In FIG. 9 is shown the arrangement of tension bridle roll 7 between the last stand 3 and the deflector roll 4 as a concrete example of the tension control means. The presence of the tension bridle roll 7 makes it possible to control the delivery side tension of the last stand and the coiling tension at different values. In this embodiment, since the wrapping angle of the strip 1 on the tension bridle roll 7 is $2\pi$, if the friction coefficient between the strip and the tension bridle roll is 0.08, delivery side tension of last stand/coiling tension $= e^{0.08\times 2\pi} \cong 1.65$ is obtained. That is, when using the above tension control means, the coiling tension can be controlled within a range of $1/1.65 \sim 1$ times the delivery side tension of the last stand. The following table shows the experimental results using the tension control means.

TABLE

| Coiling of strip having a thickness of 0.180 mm without using the cyclinder | | | |
|---|---|---|---|
| Delivery side tension of last stand | Coiling tension | Coiling tension / Delivery side tension | Coil deformation |
| 7.0 kg/mm$^2$ | 5.0 kg/mm$^2$ | 0.7 | none |
| 7.0 kg/mm$^2$ | 7.0 kg/mm$^2$ | 1.0 | presence (buckling deformation) |

As described above, the tension bridle roll is arranged between the last stand and the tension reel to independently control the rolling tension and the coiling tension at different values, which is particulary effective for the prevention of coil deformation. Further, the linear motor type tension control means may be used instead of the tension bridle roll.

Moreover, the adoption of the aforementioned tension control between the last stand and the tension roll is not so effective when cold rolling a strip in a batch system at a unit of a single coil, because in this batch system the thickness of the innermost coiled portion is thicker than the thickness of the coil product and it is difficult to produce the buckling deformation of the coil. However, when the cold rolling is carried out in a completely continuous system by welding the opposed ends of the strips to each other by means of a welder disposed in the entry side of the cold tandem mill, the tension control according to the invention is very effective because the thickness of the strip is constant.

On the other hand, when the strip is coiled on the reel, it is known from experience that the reduction of coiling tension from the inner coiled portion to the outer coiled porton (i.e. taper tension) gives a good coiled form (no coil buckling deformation, no telescopical deformation or the like). This can be achieved by the invention without influencing on the rolling conditions.

As mentioned above, according to the invention, coils having a good coiled form can be obtained in the field of using thin strips and also the coiling operation having a good rolling workability can be performed at a high product yield.

What is claimed is:

1. In a method of coiling a thin strip, the method being of the type comprising cold rolling a hot rolled steel strip through a last stand of a cold tandem mill, and coiling the cold rolled strip on a tension reel to form a coil, the improvement which comprises cold rolling the strip to a thickness of not more than 0.3 mm through the last stand of the cold tandem mill with the same roll diameter and the same speed between upper and lower work rolls thereof, and coiling the cold-rolled strip under a condition that tension bridle rolls are arranged between the last stand of the cold tandem mill and the tension reel to control delivery side tension of the last stand within a range of 5–16 kg/mm$^2$, and coiling tension within a range of 4–7 kg/mm$^2$.

* * * * *